US010891854B2

(12) United States Patent
Oyama

(10) Patent No.: US 10,891,854 B2
(45) Date of Patent: Jan. 12, 2021

(54) TRAFFIC MANAGEMENT SYSTEM

(71) Applicant: SUBARU CORPORATION, Tokyo (JP)

(72) Inventor: Hajime Oyama, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 16/744,841

(22) Filed: Jan. 16, 2020

(65) Prior Publication Data

US 2020/0312129 A1 Oct. 1, 2020

(30) Foreign Application Priority Data

Mar. 27, 2019 (JP) ..... 2019-061281

(51) Int. Cl.

| | |
|---|---|
| ***G08G 1/065*** | (2006.01) |
| ***G08G 1/01*** | (2006.01) |
| *G08G 1/00* | (2006.01) |
| *G08G 1/0968* | (2006.01) |
| *G08G 1/0962* | (2006.01) |

(52) U.S. Cl.

CPC ..... *G08G 1/0145* (2013.01); *G08G 1/0116* (2013.01); *G08G 1/0133* (2013.01); *G08G 1/065* (2013.01); *G08G 1/00* (2013.01); *G08G 1/0104* (2013.01); *G08G 1/0962* (2013.01); *G08G 1/0968* (2013.01)

(58) Field of Classification Search

CPC ..... G08G 1/00; G08G 1/0104; G08G 1/0116; G08G 1/0133; G08G 1/0145; G08G 1/065; G08G 1/0968; G08G 1/0962

See application file for complete search history.

(56) References Cited

U.S. PATENT DOCUMENTS

2008/0071465 A1* 3/2008 Chapman ..... G01C 21/3691 701/117

2013/0144516 A1* 6/2013 Sato ..... G08G 1/0145 701/118

FOREIGN PATENT DOCUMENTS

JP 2012-043094 A 3/2012

* cited by examiner

*Primary Examiner* — Benyam Haile

(74) *Attorney, Agent, or Firm* — McDermott Will & Emery LLP

(57) ABSTRACT

A traffic management system includes a traffic information collector, a traffic information acquirer, and a traffic manager. The traffic information collector collects the number of vehicles passing through a predetermined section, the traffic information acquirer acquires, as traffic information, the number of vehicles and vehicle information of vehicles passing through a vehicle sensor provided behind the predetermined section, and the traffic manager determines a traffic density based on the number of vehicles and a section length, calculates a traffic volume from the number of vehicles passing by the vehicle sensor, corrects the traffic density with the traffic volume to determine an actual traffic density, compare the actual traffic density to a determination threshold value for determining a congestion indication to check a congestion indication, and transmit a lane changing instruction signal to the vehicle traveling behind the vehicle sensor when the congestion indication is detected.

13 Claims, 6 Drawing Sheets

FIG. 3

PROBE INFORMATION

| |
|---|
| VEHICLE ID |
| DATE AND TIME |
| POSITION (LONGITUDE, LATITUDE) |
| VEHICLE SPEED |
| DIRECTION |
| ⋮ |

TRAFFIC MANAGEMENT SYSTEM

CROSS-REFERENCE TO RELATED APPLICATIONS

The present application claims priority from Japanese Patent Application No. 2019-061281 filed on Mar. 27, 2019, the entire contents of which are hereby incorporated by reference.

BACKGROUND

The technology relates to a traffic management system that is capable of detecting a traffic density for each traveling lane to prevent bias in the traffic density, and creating a traffic flow that suppresses occurrence of congestion in advance.

For example, in a road control center for managing traffic on expressways, data collected from sensors (cameras, traffic counters, etc.) installed on roadsides and probe information indicating a traveling state of each vehicle have been conventionally aggregated in a cloud server (traffic control device) to acquire traffic information (traffic density, congestion information, etc.) for each predetermined section. The traffic information is notified to vehicles traveling in the vicinity of the section, thereby suppressing occurrence of congestion.

For example, Japanese Unexamined Patent Application Publication (JP-A) No. 2012-43094 discloses a technique in which a driver of a vehicle traveling at the head of a vehicle group is provided with information indicating that the vehicle group including the vehicle of the driver at the head thereof is formed, or information on a driving operation for suppressing increase of the vehicle group to cause the driver of the head vehicle to notice that an own vehicle is blocking flow of vehicles, thereby prompting the driving operation for suppressing the increase of the vehicle group and reducing the congestion.

SUMMARY

An aspect of the technology provides a traffic management system. The system includes a traffic information collector, a vehicle sensor, a traffic control device. The traffic information collector is configured to collect a number of vehicles passing through a predetermined section for each traveling lane. The vehicle sensor is installed behind the predetermined section and configured to collect vehicle information of the vehicles passing through. The traffic control device includes a traffic information acquirer and a traffic manager. The traffic information acquirer is configured to acquire, as traffic information, the number of vehicles traveling in the predetermined section that is collected by the traffic information collector, and the vehicle information collected by the vehicle sensor. The traffic manager is configured to detect a congestion indication in the predetermined section for each traveling lane based on the traffic information acquired by the traffic information acquirer. The traffic manager includes a traffic density calculator, a traffic volume calculator, an actual traffic density calculator, a congestion indication determining unit, and an instruction signal transmitter. The traffic density calculator is configured to determine a traffic density for each traveling lane based on the number of vehicles traveling in the predetermined section acquired by the traffic information acquirer and a section length of the predetermined section. The traffic volume calculator is configured to calculate a traffic volume for each traveling lane from the number of vehicles passing by the vehicle sensor based on the vehicle information which is acquired by the traffic information acquirer and collected by the vehicle sensor. The actual traffic density calculator is configured to correct the traffic density calculated by the traffic density calculator with the traffic volume calculated by the traffic volume calculator to determine an actual traffic density for each traveling lane. The congestion indication determining unit is configured to compare the actual traffic density for each traveling lane calculated by the traffic density calculator to a preset determination threshold value for determining a congestion indication to check a traveling lane exhibiting the congestion indication. The instruction signal transmitter is configured to transmit a lane changing instruction signal to a vehicle traveling behind the vehicle sensor when a traveling lane exhibiting the congestion indication is detected by the congestion indication determining unit.

Another aspect of the technology provides a traffic management system including a vehicle sensor and circuitry. The vehicle sensor is installed behind a predetermined section and configured to collect vehicle information of vehicles passing through a predetermined section. The circuitry is configured to collect a number of the vehicles passing through the predetermined section for each traveling lane. The circuitry is configured to acquire, as traffic information, the collected number of the vehicles traveling in the predetermined section and the vehicle information. The circuitry is configured to detect a congestion indication in the predetermined section for each traveling lane based on the acquired traffic information. The circuitry is configured to determine a traffic density for each traveling lane based on the acquired number of vehicles traveling in the predetermined section and a section length of the predetermined section. The circuitry is configured to calculate a traffic volume for each traveling lane from a number of the vehicles passing by the vehicle sensor based on the vehicle information collected by the vehicle sensor. The circuitry is configured to correct the traffic density with the traffic volume to determine an actual traffic density for each traveling lane. The circuitry is configured to compare the actual traffic density for each traveling lane to a preset determination threshold value for determining a congestion indication to check a traveling lane exhibiting the congestion indication. The circuitry is configured to transmit a lane changing instruction signal to a vehicle traveling behind the vehicle sensor when a traveling lane exhibiting the congestion indication is detected.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

FIG. 3 is an explanatory diagram illustrating an example of probe information transmitted from a vehicle to the cloud server;

DETAILED DESCRIPTION

In the following, some embodiments of the disclosure are described in detail with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Traffic information provided by a traffic control system disclosed in JP-A No. 2012-43094 is useful for a preceding vehicle, but it is not expectable to suppress occurrence of congestion even if following vehicles acquire the same information.

In addition, among the vehicles that pass through, there are a vehicle having no receiving equipment, a vehicle that has the receiving equipment such as a car navigation system, but is dedicated to manual driving, a vehicle in which even when traffic information is acquired, the driver thereof drives without following the instruction, etc., so that it is difficult to perform intended traffic control.

Therefore, in view of the above circumstances, it is desirable to provide a traffic management system that is capable of creating a traffic flow for suppressing occurrence of congestion in advance even under a traffic environment in which there are various vehicles.

Figure 1:
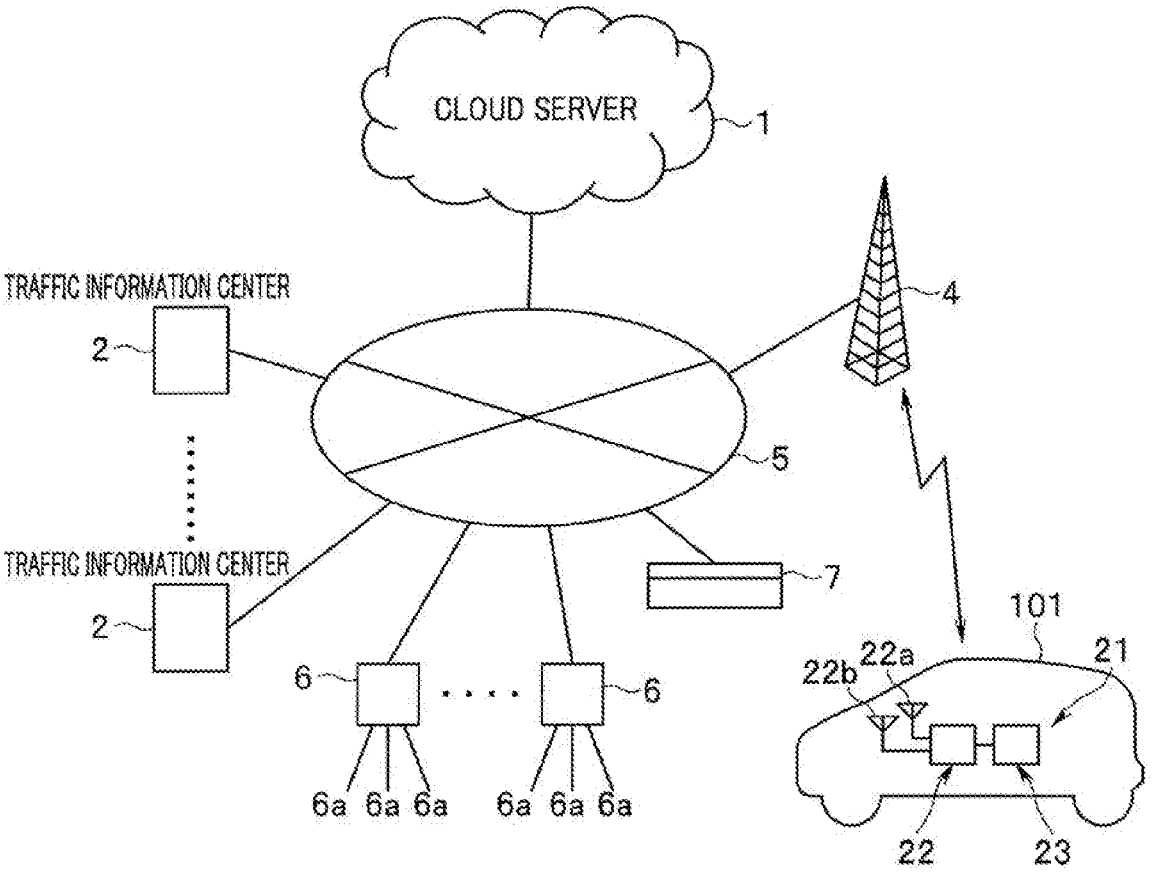
FIG. 1 is a schematic configuration diagram of a traffic management system.

An embodiment of the technology will be described with reference to the drawings. A traffic management system illustrated in FIG. 1 is configured to include a cloud server 1 serving as a traffic control device, traffic information centers 2 serving as traffic information collectors, and a base station 4, which are connected to one another via the Internet 5 serving as traffic information transmission means.

Each of the traffic information center 2 is controlled under private and public institutions, aggregates traffic information varying from moment to moment (for example, the number of vehicles traveling in each section) and environment information for each traveling lane in each preset section, and transmits the aggregated traffic information and environment information as traffic information to the cloud server 1. For example, the private traffic information center collects probe information acquired from each contracted probe vehicle, and transmits the traffic information obtained based on the collected information to the cloud server 1. Furthermore, for example, the traffic information center of the public institution collects traffic information for each traveling lane in each section which is acquired from various vehicle sensing sensors (cameras, traffic counters, etc.) 3 (see FIGS. 5 and 6) serving as vehicle sensors installed in advance on roads, prefectural polices, road traffic managers, etc., and transmits the collected traffic information to the cloud server 1.

As illustrated in FIG. 3, the probe information to be transmitted from the each probe vehicle to the traffic information center 2 includes a vehicle ID of an own vehicle, a transmission date and time, a current position (latitude, longitude), a vehicle speed, a traveling direction, etc., and a traffic information center 2 that has received this probe information acquires traffic information (crowded state, congestion information, etc.) for the each predetermined section based on this information.

Figure 2:
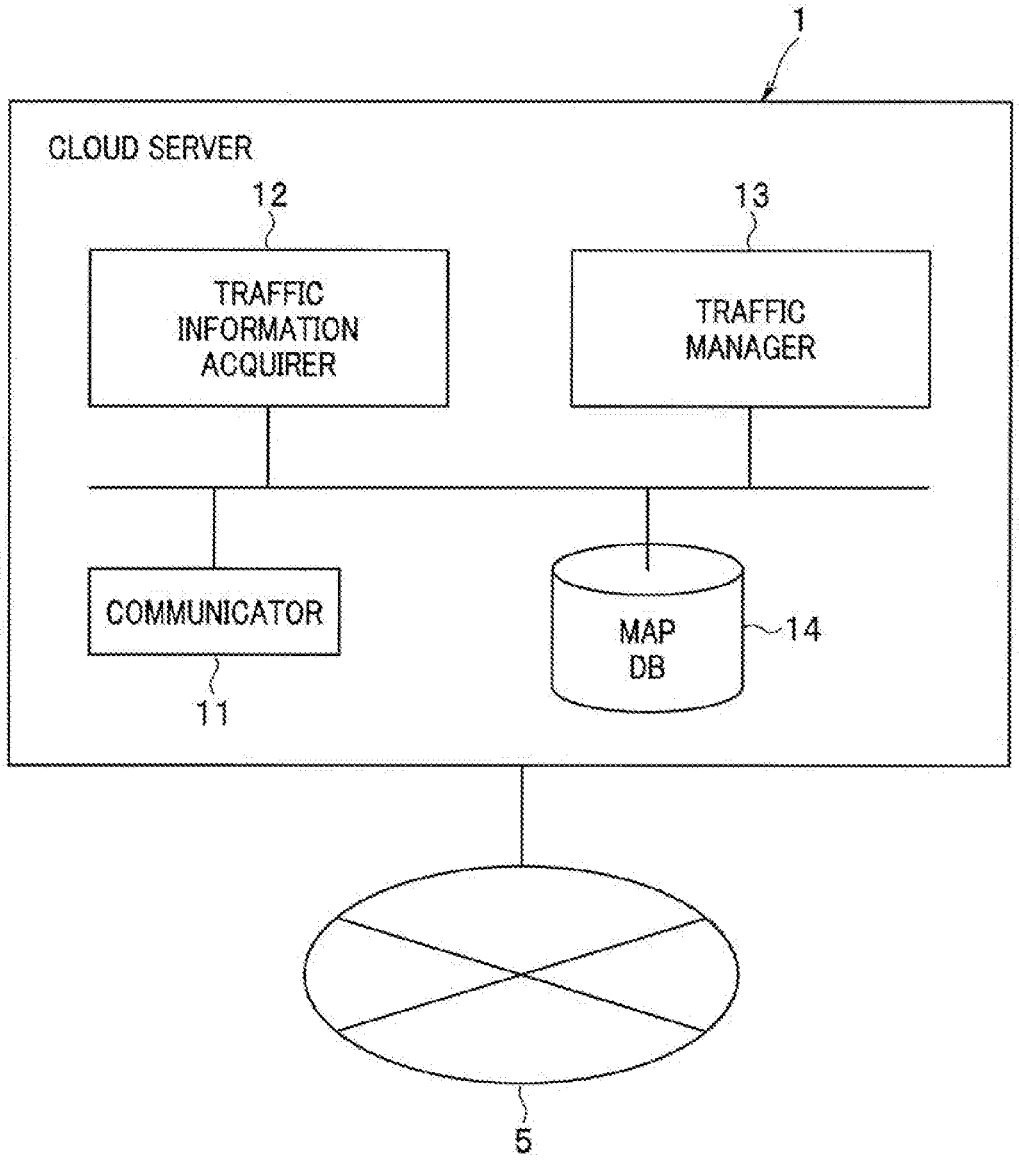
FIG. 2 is a schematic configuration diagram of a cloud server.

As illustrated in FIG. 2, the cloud server 1 includes a communicator 11, a traffic information acquirer 12, a traffic manager 13, and a map database unit 14. The traffic information acquirer 12 acquires and aggregates the traffic information transmitted from the each traffic information center 2 and the each base station 4 via the communicator 11.

The traffic manager 13 determines a traffic density (the number of vehicles/section length) of the each section at a predetermined time interval (1 to 2 [min]) based on the traffic information aggregated by the traffic information acquirer 12 to check a section (area) exhibiting an indication that congestion is likely to occur (hereinafter referred to as "congestion indication"), and checks the tendency of the congestion indication in the section concerned for each lane. Then, the traffic information is processed in real time to sequentially update the road traffic information of a global dynamic map stored in the map database unit 14.

This global dynamic map has a four-layered structure in which a static information layer as a lowest layer serves as a base and additional map information necessary to support automatic driving is superimposed on the static information layer. The static information layer is the lowest base information layer and stores high-accuracy three-dimensional map information, such as road surface information, lane information, intersection information, three-dimensional structures, and permanent regulation information, which are static information with the least change.

The additional map information superimposed on the static information layer is segmented into three layers, and includes a quasi-static information layer, a quasi-dynamic information layer, and a dynamic information layer in order from the lowest layer. These layers are classified according to the degree of change (fluctuation) on the time axis, and the traffic information described above is stored on the dynamic information layer because the traffic information changes most frequently and thus is required to be updated in real time. Note that the global dynamic map is a map required when an automatically drivable vehicle 101 described later is caused to travel autonomously.

Figure 6:
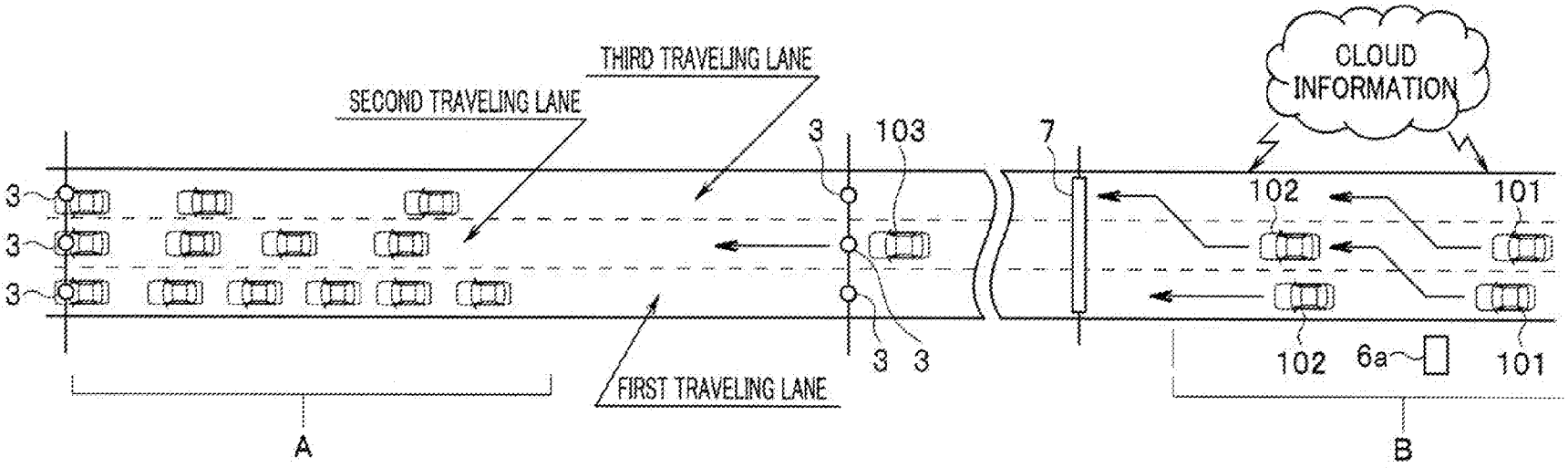
FIG. 6 is an explanatory diagram illustrating a state in which cloud information is transmitted to a traveling vehicle according to another aspect.

The cloud server 1 is connected to road-to-vehicle communication systems 6 and a road information board 7 serving as display equipment via the Internet 5. The road-to-vehicle communication system 6 includes roadside devices (for example, roadside beacons) 6*a* each of which is disposed in each predetermined section of a road, and based on the traffic information acquired from the cloud server 1, the road-to-vehicle communication system 6 transmits the traffic information to the corresponding roadside device 6*a*. This traffic information is received by a car navigation system or the like which is mounted in the vehicle and notified to the driver. The road information board 7 is installed on the road as illustrated in FIG. 6, and notifies the driver of a road condition by displaying the road traffic information and the like in characters, pictograms or the like.

Here, the configuration of the vehicle 101 capable of performing automatic driving will be briefly described. The vehicle 101 is equipped with an automatic driving assistance device 21 for causing the own vehicle to travel autonomously without depending on any driver's operation in an automatic driving section. The automatic driving assistance device 21 includes a locator unit 22 and a vehicle control unit 23, and the locator unit 22 is provided with a traffic information receiver 22*a* and a GNSS receiver 22*b*.

The locator unit 22 estimates the position of the own vehicle based on positioning signals which are received from a plurality of positioning satellites by the GNSS receiver 22*b*. Furthermore, the locator unit 22 accesses the cloud server 1 from the traffic information receiver 22*a* via the base station 4 and the Internet 5 to acquire the traffic information and the map information stored in the global dynamic map. The locator unit 22 performs map-matching of the position of the own vehicle on the map based on the map information received by the traffic information receiver 22*a*, and constructs a traveling route that connects an input destination and the position of the own vehicle. Then, the locator unit 22 specifies a driving lane based on the acquired traffic information.

When a section in which the automatic driving can be performed (automatic driving section) is set in a constructed traveling route, the vehicle control unit 23 performs automatic driving in the automatic driving section according to the constructed traveling route. In a section where the automatic driving is not set, the vehicle control unit 23 performs driving assistance control based on well-known adaptive cruise control (ACC) and active lane keep (ALK) control, thereby causing the own vehicle to travel.

Figure 5:
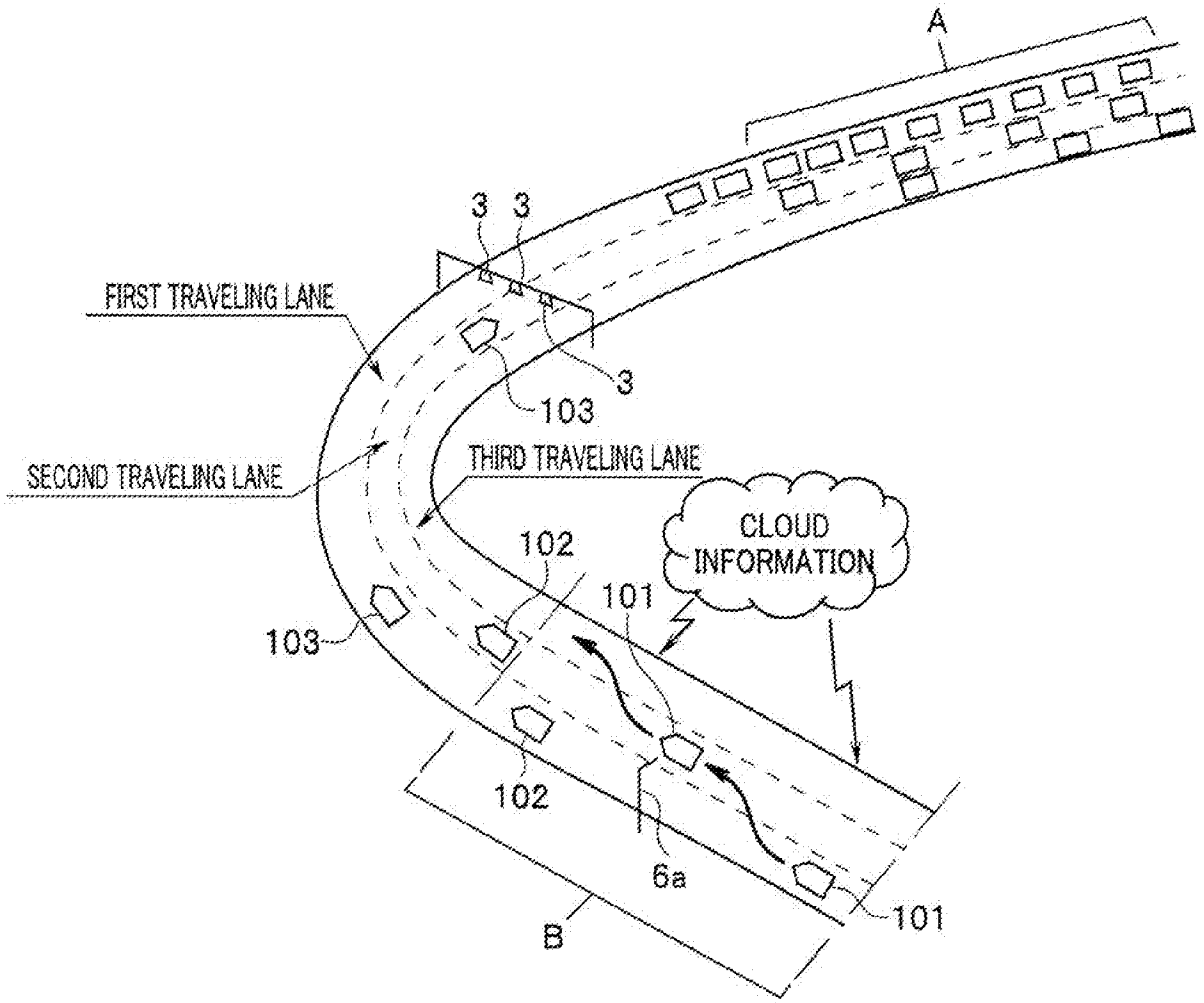
FIG. 5 is an explanatory diagram illustrating a state in which cloud information is transmitted to a traveling vehicle.

Under the automatic driving, the vehicle control unit 23 causes the own vehicle to travel on a traveling lane set by the locator unit 22, for example, a first traveling lane (see FIGS. 5 and 6). At that time, when a signal for instructing lane change is emitted from the cloud server 1 because there is a indication indicating that congestion is likely to occur ahead of the vehicle 101 on a lane on which the vehicle 101 travels currently (for example, the first traveling lane), the vehicle control unit 23 performs lane change according to the lane changing instruction.

The detection of a lane under a congestion indication and the lane changing instruction are performed based on the traffic information aggregated by the traffic information acquirer 12 in the traffic manager 13 of the cloud server 1 described above for each predetermined section (for example, 1 to 2 [Km]).

Figure 4:
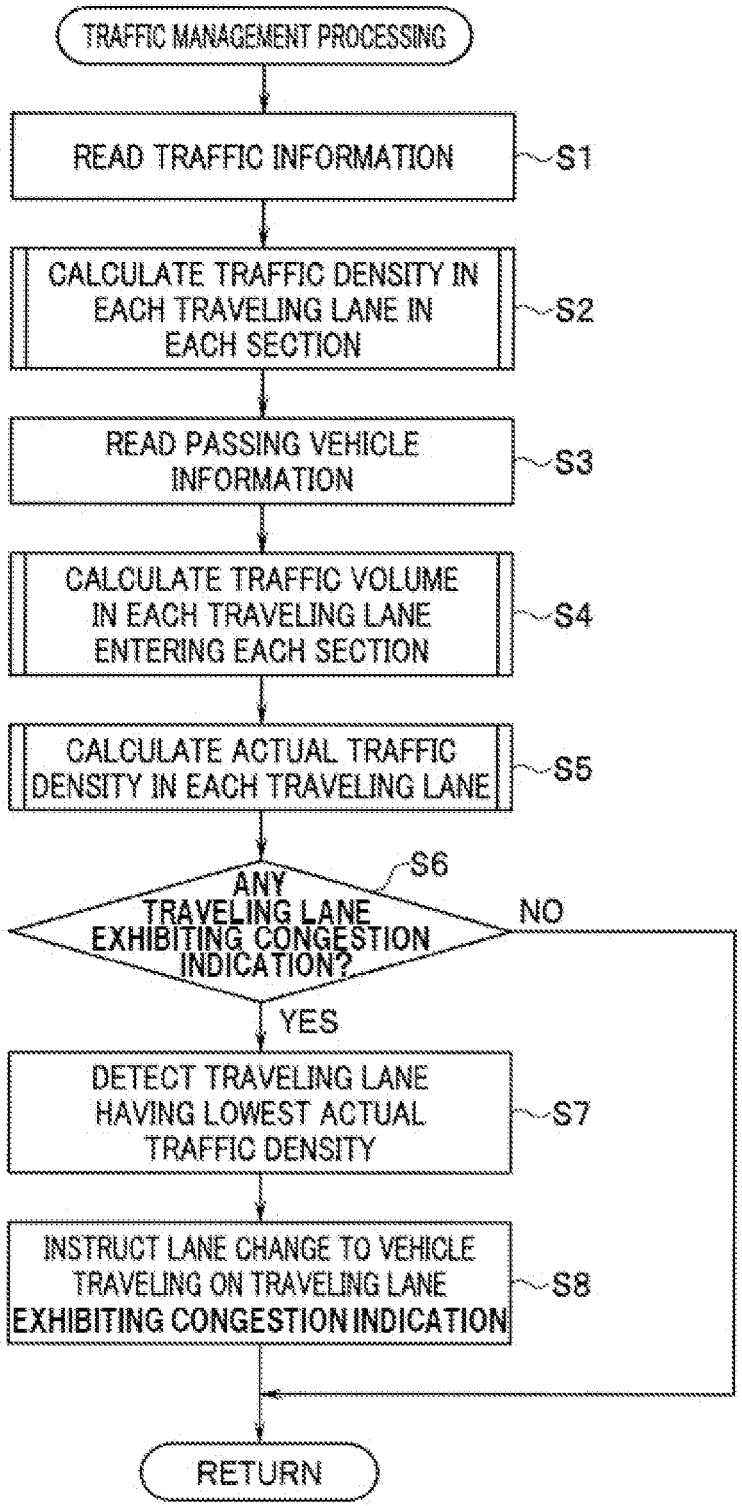
FIG. 4 is a flowchart illustrating a traffic management processing routine.

In one embodiment, the detection of the congestion indication and the lane changing instruction determined by the traffic manager 13 are performed in a traffic management processing routine illustrated in FIG. 4. In this routine, the traffic information aggregated by the traffic information acquirer 12 is first read in step S1, and a traffic density K' for each lane in each section is determined in step S2. In one embodiment, the processing in step S2 may serve as a "traffic density calculator".

For example, when the speed of each vehicle traveling in a predetermined section gradually decreases, the inter-vehicle distance of the each vehicle gradually decreases, and the traffic density K' increases. This traffic density K' is estimated from the number of vehicles existing in the section (the number of vehicles/the length of the section). Incidentally, when the traffic density K' is multiplied by the average vehicle speed (spatial average speed) Va of vehicles traveling in a specific section, a traffic volume Q in the section can be known ($Q=K'\cdot Va$).

By the way, the traffic information for the each section aggregated by the traffic information acquirer 12 is based on the traffic information acquired by the traffic information centers 2. In the each traffic information center 2, the traffic density K' of each section is determined based on the probe information acquired from the probe vehicle, the various vehicle sensing sensors 3 installed in advance on roads, and the traffic information obtained from the prefectural polices, road traffic managers, etc.

In this case, in the traffic management processing routine, the traffic information of a preset section A (see FIGS. 5 and 6) is acquired by the traffic information acquirer 12 to determine a traffic density K', and it is possible to detect the congestion indication for each lane from an increasing trend of the traffic density K'.

However, it is not possible to suppress occurrence of congestion by merely detecting the congestion indication. In order to suppress occurrence of congestion in the specific section A, it is necessary to distribute following vehicles from a traveling lane having a high traffic density K' to a traveling lane having a low traffic density K'. In this case, if all the vehicles are automatically drivable vehicles 101, the vehicles can be distributed to the intended traveling lane by auto lane changing (ALC) control according to the lane changing instruction from the cloud server 1. In the case of a vehicle 102 which is dedicated to manual driving and equipped with the car navigation system (see FIGS. 5 and 6), the lane changing instruction is output from the roadside device 6*a* of the road-to-vehicle communication system 6 to the car navigation system, whereby the driver can be prompted to perform lane change.

However, vehicles traveling in the same section include vehicles 103 that are not equipped with receiving equipment such as the car navigation system, and further, a driver who is driving a vehicle 102 equipped with receiving equipment may not follow the lane changing instruction. Alternatively, even in the case of the vehicle 101 capable of performing the automatic driving, when the vehicle 101 is traveling straight under the driving assistance control based on the above-described ACC and ALK control, the driver may continue the straight traveling as it is without performing the lane change by operating the steering wheel.

In this way, when various vehicles are traveling on a road in a mixed manner and the following vehicles that do not follow the lane changing instruction enter the section A described above, bias in the traffic density may occur on each traveling lane.

Therefore, in the present embodiment, vehicles entering the section A for which a congestion indication is detected, and the traffic density K' is corrected with the number C of these vehicles passing through the section A to detect an actual traffic density (real traffic density) K.

In other words, in step S3, passing vehicle information (the number C of passing vehicles) for each traveling lane in a target section which has been detected by the vehicle sensing sensors 3 described above is read.

Next, in step S4, the traffic volume U (C/hour) for each traveling lane entering each section is calculated from the number C of passing vehicles per unit time (about 1 to 2 [min]). In one embodiment, the processing in step S4 may serve as a "traffic volume calculator".

Thereafter, the processing proceeds to step S5 to correct the traffic density K' with this traffic volume U and determine the actual traffic density (real traffic density) K for each traveling lane in each section. In other words, the actual traffic density K is calculated by dividing the traffic volume U by the section length of the section and adding the value to the traffic density K'(K=K'+(U/section length)). In one embodiment, the processing in step S5 may serve as an "actual traffic density calculator".

Incidentally, by adding the traffic volume U determined from the number C of passing vehicles to the traffic volume Q determined from the actual traffic density K' described above, a traffic volume when the C vehicles have reached the section can be determined.

Thereafter, the processing proceeds to step S6 to compare the actual traffic density K to a threshold value for determining a congestion indication (indication determination threshold value) Ko for each traveling lane, and check whether there is a traveling lane exhibiting a congestion indication. In one embodiment, the processing in step S6 may serve as a "congestion indication determining unit".

The indication determination threshold value Ko is set to a value of about 80 to 90 [%] of the traffic density K which is regarded as congestion. However, the indication determination threshold value Ko is not limited thereto, and for example, it may be set to different values for a general road and an expressway, respectively.

In a case of K≤Ko, it is determined that there is no congestion indication, and the processing exits the routine. On the other hand, in a case of K>Ko, it is determined that there is a congestion indication, and the processing proceeds to step S7. In step S7, the traveling lane having the lowest actual traffic density K is detected on a roadway in the section, and the processing proceeds to step S8. In one embodiment, the processing in step S7 may serve as a "low-density traveling lane detector".

In step S8, lane change to a lane having the lowest traffic density K is instructed to the vehicle which is traveling on the traveling lane exhibiting the congestion indication in a rear section (notification section) B (see FIGS. 5 and 6) and will enter the section A, and then the processing exits the routine. In one embodiment, the processing in step S8 may serve as an "instruction signal transmitter".

For example, as illustrated in FIGS. 5 and 6, when it is determined that the traffic density K of the first traveling lane is higher than the indication determination threshold value Ko in the section A of a three-lane road (K>Ko), lane change to a traveling lane (the third traveling lane in FIGS. 5 and 6) having the lowest traffic density K out of the traffic densities K of the second and third traveling lanes is instructed to the vehicle traveling on the first traveling lane in the notification section B.

This lane changing instruction is transmitted as cloud information from the cloud server 1 via the Internet 5 to the traffic information centers 2, the base station 4, the road-to-vehicle communication systems 6, and the road information board 7.

The vehicle 101 (see FIG. 1) traveling under the automatic driving receives the cloud information transmitted from the base station 4 by the traffic information receiver 22*a*, and reflects the received cloud information to the map information of the locator unit 22. As a result, according to the lane changing instruction from the cloud server 1, the vehicle 101 performs auto lane changing (ALC) control to change a course to a lane having the low traffic density.

The road-to-vehicle communication system 6 outputs a lane changing instruction signal from the roadside device (for example, an on-road beacon) 6*a* installed on the roadside of the notification section B. At this time, the receiving equipment such as the car navigation system installed in the vehicle 102 receives the lane changing instruction signal from the cloud server 1 via the roadside device 6*a*, displays a pictograph indicating the lane change on the monitor, and notifies lane change to the driver with sound. As a result, the driver driving the vehicle 102 changes the course to the instructed traveling lane (third traveling lane) by his/her steering.

Furthermore, information for prompting course change is displayed in both pictograms and letters as an instruction of lane change to the third traveling lane on the road information board 7 installed in front of the notification section B for vehicles traveling on the first traveling lane. As a result, the drivers driving the vehicles 103 which are not equipped with the receiving equipment can be also prompted to change the course to the third traveling lane by causing the drivers to visually recognize the information displayed on the road information board 7.

As described above, according to the present embodiment, it is possible to prevent bias in the traffic density K of the vehicles traveling on the first to third traveling lanes set in the section A and suppress occurrence of congestion. As a result, even under a traffic environment in which there are various vehicles, a traffic flow that suppresses occurrence of congestion in advance can be created.

The technology is not limited to the above-described embodiment, and for example, the traffic density K' may be calculated from the total inter-vehicle distances among vehicles per section length (K'=total inter-vehicle distances/section length).

In addition to the microcomputer described above, the cloud server 1, the locator unit 22 and the vehicle control unit 23 installed in the vehicle 101 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the cloud server 1 including the communicator 11, the traffic information acquirer 12, and the traffic manager 13 (see FIG. 2), and the locator unit 22 and the vehicle control unit 23 installed in the vehicle 101. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and an SRAM, and the nonvolatile memory may include a ROM and an NVRAM. The ASIC is an integrated circuit (IC) customized to perform, and the FPGA is an integrated circuit designed to be configured after manufacturing in order to perform, all or a part of the functions of the modules illustrated in FIGS. 1 and 2.

Although some embodiments of the technology have been described in the foregoing by way of example with reference to the accompanying drawings, the technology is by no means limited to the embodiments described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

As described above, according to the technology, a traffic density is determined for each traveling lane based on the number of vehicles traveling in a predetermined section and the length of the section, a traffic volume is calculated for each traveling lane from the number of passing vehicles which have been detected by the vehicle sensor installed behind the predetermined section and have passed by the vehicle sensor, the traffic density is corrected with the traffic volume to determine an actual traffic density for each traveling lane, the calculated actual traffic density for each traveling lane is compared to a preset determination threshold value for determining a congestion indication to check a traveling lane exhibiting a congestion indication, and a lane changing instruction signal is transmitted to a vehicle traveling behind the vehicle sensor when a traveling lane exhibiting the congestion indication is detected. Therefore, even under a traffic environment in which there are various vehicles, the traffic density in the predetermined section is corrected by the traffic volume calculated based on the passing vehicles detected by the vehicle sensor, so that bias in the traffic density can be prevented, and a traffic flow which suppresses occurrence of congestion in advance can be created.

The invention claimed is:

1. A traffic management system comprising:

a traffic information collector configured to collect a number of vehicles passing through a predetermined section for each traveling lane;

a vehicle sensor installed behind the predetermined section and configured to collect vehicle information of the vehicles passing through; and a traffic control device comprising:

a traffic information acquirer configured to acquire, as traffic information, the number of vehicles traveling in the predetermined section that is collected by the traffic information collector, and the vehicle information collected by the vehicle sensor; and a traffic manager configured to detect a congestion indication in the predetermined section for each traveling lane based on the traffic information acquired by the traffic information acquirer, the traffic manager comprising:

a traffic density calculator configured to determine a traffic density for each traveling lane based on the number of vehicles traveling in the predetermined section acquired by the traffic information acquirer and a section length of the predetermined section;

a traffic volume calculator configured to calculate a traffic volume for each traveling lane from the number of vehicles passing by the vehicle sensor based on the vehicle information which is acquired by the traffic information acquirer and collected by the vehicle sensor;

an actual traffic density calculator configured to correct the traffic density calculated by the traffic density calculator with the traffic volume calculated by the traffic volume calculator to determine an actual traffic density for each traveling lane;

a congestion indication determining unit configured to compare the actual traffic density for each traveling lane calculated by the traffic density calculator to a preset determination threshold value for determining a congestion indication to check a traveling lane exhibiting the congestion indication; and an instruction signal transmitter configured to transmit a lane changing instruction signal to a vehicle traveling behind the vehicle sensor when a traveling lane exhibiting the congestion indication is detected by the congestion indication determining unit.

2. The traffic management system according to claim 1, wherein when the traveling lane exhibiting the congestion indication is detected by the congestion indication determining unit, the instruction signal transmitter is configured to transmit the lane changing instruction signal for instructing change of the traveling lane to the vehicles traveling on the traveling lane exhibiting the congestion indication.

3. The traffic management system according to claim 2, wherein the traffic manager further comprises a low density traveling lane detector configured to detect the traveling lane lowest in the actual traffic density when the traveling lane exhibiting the congestion indication is detected by the congestion indication determining unit, and the instruction signal transmitter is configured to transmit the lane changing instruction signal for instructing lane change to the traveling lane lowest in the actual traffic density to the vehicles traveling on a traveling lane exhibiting the congestion indication.

4. The traffic management system according to claim 1, wherein the instruction signal transmitter is configured to transmit the lane changing instruction signal for causing the vehicle traveling under automatic driving to execute automatic lane changing control.

5. The traffic management system according to claim 2, wherein the instruction signal transmitter is configured to transmit the lane changing instruction signal for causing the vehicle traveling under automatic driving to execute automatic lane changing control.

6. The traffic management system according to claim 3, wherein the instruction signal transmitter is configured to transmit the lane changing instruction signal for causing the vehicle traveling under automatic driving to execute automatic lane changing control.

7. The traffic management system according to claim 1, wherein the instruction signal transmitter transmits the lane changing instruction signal to display equipment installed on a road to display a lane changing instruction.

8. The traffic management system according to claim 2, wherein the instruction signal transmitter transmits the lane changing instruction signal to display equipment installed on a road to display a lane changing instruction.

9. The traffic management system according to claim 3, wherein the instruction signal transmitter transmits the lane changing instruction signal to display equipment installed on a road to display a lane changing instruction.

10. The traffic management system according to claim 4, wherein the instruction signal transmitter transmits the lane changing instruction signal to display equipment installed on a road to display a lane changing instruction.

11. The traffic management system according to claim 5, wherein the instruction signal transmitter transmits the lane changing instruction signal to display equipment installed on a road to display a lane changing instruction.

12. The traffic management system according to claim 6, wherein the instruction signal transmitter transmits the lane changing instruction signal to display equipment installed on a road to display a lane changing instruction.

13. A traffic management system comprising a vehicle sensor installed behind a predetermined section and configured to collect vehicle information of vehicles passing through a predetermined section; and circuitry configured to collect a number of the vehicles passing through the predetermined section for each traveling lane, acquire, as traffic information, the collected number of the vehicles traveling in the predetermined section and the vehicle information detect a congestion indication in the predetermined section for each traveling lane based on the acquired traffic information, determine a traffic density for each traveling lane based on the acquired number of vehicles traveling in the predetermined section and a section length of the predetermined section;

calculate a traffic volume for each traveling lane from a number of the vehicles passing by the vehicle sensor based on the vehicle information collected by the vehicle sensor;

correct the traffic density with the traffic volume to determine an actual traffic density for each traveling lane;

compare the actual traffic density for each traveling lane to a preset determination threshold value for determining a congestion indication to check a traveling lane exhibiting the congestion indication; and transmit a lane changing instruction signal to a vehicle traveling behind the vehicle sensor when the traveling lane exhibiting a congestion indication is detected.

* * * * *